US009581335B2

(12) United States Patent
Cihlar et al.

(10) Patent No.: US 9,581,335 B2
(45) Date of Patent: Feb. 28, 2017

(54) FUEL NOZZLE TUBE RETENTION

(71) Applicant: General Electric Company, Schenectady, NY (US)

(72) Inventors: David William Cihlar, Greenville, SC (US); Patrick Benedict Melton, Horse Shoe, NC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 329 days.

(21) Appl. No.: 14/453,950

(22) Filed: Aug. 7, 2014

(65) Prior Publication Data

US 2016/0040882 A1 Feb. 11, 2016

(51) Int. Cl.
*F23R 3/28* (2006.01)

(52) U.S. Cl.
CPC ..... *F23R 3/286* (2013.01); *F23R 3/283* (2013.01)

(58) Field of Classification Search
CPC .. F23R 3/286; F23R 3/283; F23R 3/32; F02C 7/20; F02C 7/32
See application file for complete search history.

(56) References Cited

U.S. PATENT DOCUMENTS

| | | | | |
|---|---|---|---|---|
| 2,810,260 | A * | 10/1957 | Fromm | F23R 3/32 431/242 |
| 4,454,711 | A * | 6/1984 | Ben-Porat | F23R 3/10 60/748 |
| 2007/0151255 | A1* | 7/2007 | Johnson | F23D 14/48 60/776 |
| 2013/0186092 | A1 | 7/2013 | Bathina et al. | |
| 2013/0192234 | A1 | 8/2013 | Stewart et al. | |
| 2013/0199188 | A1 | 8/2013 | Boardman et al. | |
| 2013/0213051 | A1 | 8/2013 | Westmoreland, III et al. | |
| 2013/0232977 | A1* | 9/2013 | Siddagangaiah | F23R 3/14 60/737 |
| 2013/0241089 | A1 | 9/2013 | Westmoreland, III et al. | |
| 2013/0247581 | A1 | 9/2013 | Melton et al. | |
| 2013/0269351 | A1 | 10/2013 | Hu et al. | |
| 2014/0338356 | A1* | 11/2014 | Keener | F23R 3/286 60/776 |
| 2015/0226435 | A1* | 8/2015 | Melton | F23R 3/286 60/737 |

* cited by examiner

*Primary Examiner* — Andrew Nguyen
(74) *Attorney, Agent, or Firm* — Dority & Manning, PA

(57) ABSTRACT

A system for retaining a fuel nozzle premix tube includes a retention plate and a premix tube which extends downstream from an outlet of a premix passage defined along an aft side of a fuel plenum body. The premix tube includes an inlet end and a spring support feature which is disposed proximate to the inlet end. The premix tube extends through the retention plate. The spring retention feature is disposed between an aft side of the fuel plenum and the retention plate. The system further includes a spring which extends between the spring retention feature and the retention plate.

17 Claims, 5 Drawing Sheets

FUEL NOZZLE TUBE RETENTION

FEDERAL RESEARCH STATEMENT

This invention was made with United States Government support under contract number DE-FC26-05NT42643 awarded by the Department of Energy. The United States Government may have certain rights in the invention.

FIELD OF THE INVENTION

The present invention generally involves a fuel nozzle for a gas turbine combustor. More specifically, the invention relates to a tube retention system for a bundled tube or micro-mixer type fuel nozzle.

BACKGROUND OF THE INVENTION

Gas turbines are widely used in industrial, marine, aircraft and power generation operations. A gas turbine includes a compressor section, a combustion section disposed downstream from the compressor section and a turbine section positioned downstream from the combustion section. The combustion section generally includes multiple combustor cans annularly arranged around an outer casing such as a compressor discharge casing. In particular configurations, each combustor can includes multiple bundled tube or micro-mixer type fuel nozzles which may be annularly arranged around a center fuel nozzle.

Bundled tube or micro-mixer type fuel nozzles generally include a fuel plenum, multiple premix passages which extend through the fuel plenum and multiple premix tubes which extend downstream from the premix passages. More particularly, each premix tube extends downstream from an outlet of a corresponding premix passage.

In operation, fuel is supplied to the fuel plenum and compressed air is directed into each premix passage. The fuel is then injected into the flow of compressed air within each premix passage via one or more fuel ports which provide for fluid communication between the fuel plenum and the corresponding premix passage. The fuel and air premix into a combustible fuel-air mixture as they flow out of the premix passages and downstream through the premix tubes. The combustible mixture flows out of each premix tube and into a combustion chamber where it is burned to produce combustion gases.

Currently, each premix tube is attached to the fuel plenum by first aligning the premix tube with a corresponding premix passage and brazing and/or welding the premix tube to the fuel plenum. While effective, these assembly techniques are very time consuming and complex due in part to the large number of premix tubes being placed in a relatively small area. In addition, current assembly techniques result in the formation of a permanent connection between the premix tubes and the fuel plenum which is not conducive for repair/replacement of a damaged premix tube, particularly a premix tube which is surrounded by other premix tubes, following a combustion interval. Accordingly, a system for seating the premix tubes against the fuel plenum which does not require a rigid connection would be useful.

BRIEF DESCRIPTION OF THE INVENTION

Aspects and advantages of the invention are set forth below in the following description, or may be obvious from the description, or may be learned through practice of the invention.

One embodiment of the present invention is a system for retaining a fuel nozzle premix tube. The system includes a retention plate and a premix tube which extends downstream from an outlet of a premix passage defined along an aft side of a fuel plenum body. The premix tube includes an inlet end and a spring support feature which is disposed proximate to the inlet end. The premix tube extends through the retention plate. The spring retention feature is disposed between an aft side of the fuel plenum and the retention plate. The system further includes a spring which extends between the spring retention feature and the retention plate.

Another embodiment of the present disclosure is a fuel nozzle. The fuel nozzle includes a fuel plenum body. The fuel plenum body includes a forward side axially spaced from an aft side, a fuel plenum defined between the forward and aft sides and a premix passage which extends through the fuel plenum. The premix passage is in fluid communication with the fuel plenum. The premix passage includes an inlet at the forward side and an outlet at the aft side. The fuel nozzle further includes a premix tube which extends downstream from the outlet of the premix passage. The premix tube includes an inlet end and a spring support feature which is disposed proximate to the inlet end. A retention plate defines a premix tube hole and the premix tube extends through the premix tube hole. The spring retention feature is disposed between the aft side and the retention plate. The fuel nozzle further includes a spring that extends between the spring retention feature and the retention plate.

The present invention also includes a gas turbine. The gas turbine includes a compressor section, a combustion section downstream from the compressor section and a turbine section downstream from the combustion section. The combustion section includes at least one combustor. The combustor comprises a plurality of fuel nozzles annularly arranged around a common axial centerline. Each fuel nozzle includes a fuel plenum body. The fuel plenum body includes a forward side which is axially spaced from an aft side and a fuel plenum defined between the forward and aft sides. Each fuel nozzle also includes a plurality of premix passages in fluid communication with the corresponding fuel plenum. Each premix passage includes an inlet which is defined along the forward side of the fuel plenum body and an outlet defined along the aft side of the fuel plenum body. Each fuel nozzle further includes a plurality of premix tubes. Each premix tube extends downstream from a corresponding premix passage outlet. Each premix tube includes an inlet end and a spring support feature disposed proximate to the inlet end. A retention plate defines a plurality of premix tube holes and each premix tube extends through a corresponding premix tube hole. The spring retention feature of each premix tube is disposed between the aft side of the fuel plenum body and the retention plate. Each fuel nozzle further includes a plurality of springs where each spring at least partially surrounds a corresponding premix tube and extends between the spring retention feature of the corresponding premix tube and the retention plate.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
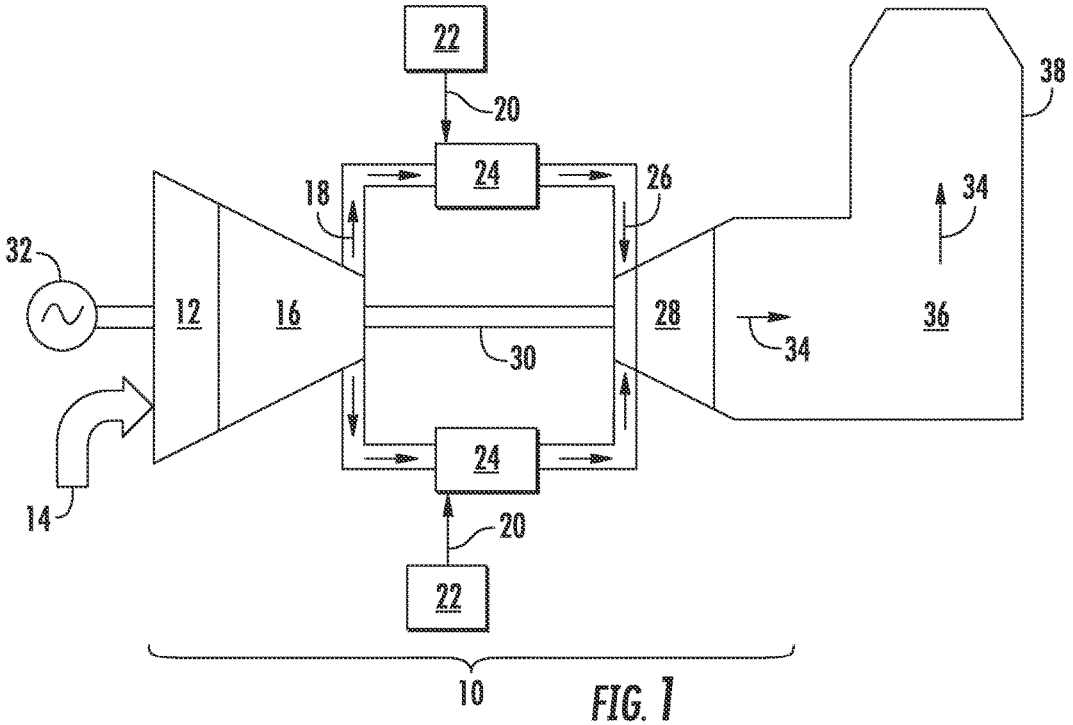
FIG. 1 PRIOR ART
FIG. 1 is a functional block diagram of an exemplary gas turbine that may incorporate various embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of a bundled tube fuel nozzle for a land based power generating gas turbine combustor for purposes of illustration, one of ordinary skill in the art will readily appreciate that embodiments of the present invention may be applied to any combustor for any type of gas turbine such as a marine or aircraft gas turbine and are not limited to combustors or combustion systems for land based power generating gas turbines unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition air 14 or other working fluid entering the gas turbine 10. The air 14 flows to a compressor section where a compressor 16 progressively imparts kinetic energy to the air 14 to produce compressed air 18.

The compressed air 18 is mixed with a fuel 20 from a fuel supply system 22 to form a combustible mixture within one or more combustors 24. The combustible mixture is burned to produce combustion gases 26 having a high temperature, pressure and velocity. The combustion gases 26 flow through a turbine 28 of a turbine section to produce work. For example, the turbine 28 may be connected to a shaft 30 so that rotation of the turbine 28 drives the compressor 16 to produce the compressed air 18. Alternately or in addition, the shaft 30 may connect the turbine 28 to a generator 32 for producing electricity. Exhaust gases 34 from the turbine 28 flow through an exhaust section 36 that connects the turbine 28 to an exhaust stack 38 downstream from the turbine 28. The exhaust section 36 may include, for example, a heat recovery steam generator (not shown) for cleaning and extracting additional heat from the exhaust gases 34 prior to release to the environment.

Figure 2:
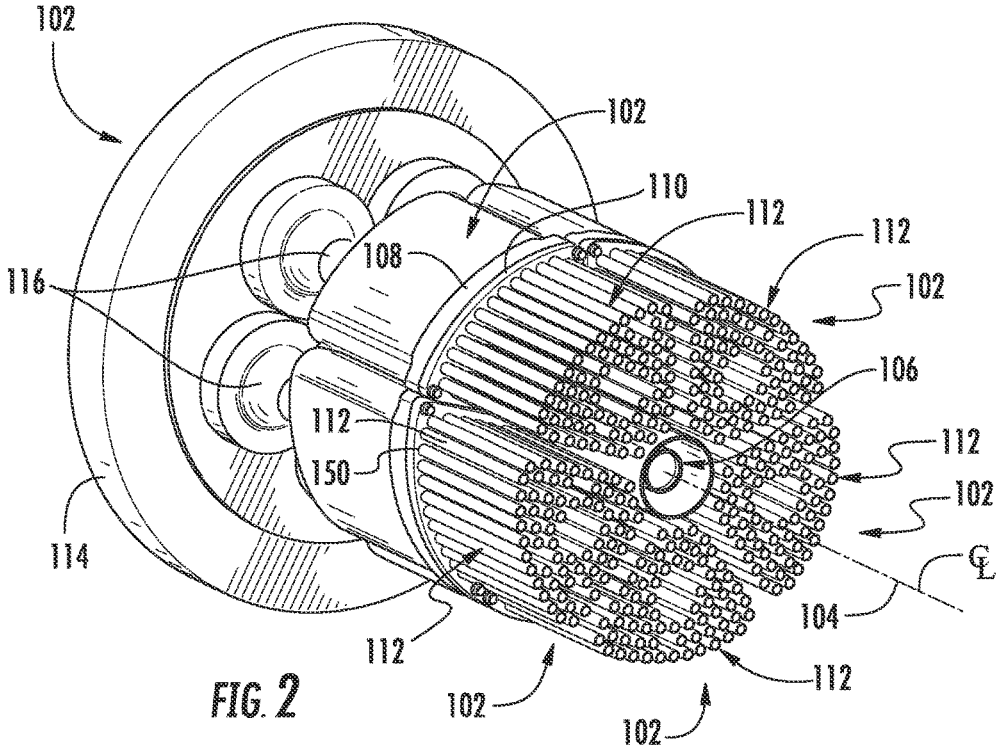
FIG. 2 is a perspective view of a portion of an exemplary combustor as may incorporate various embodiments of the present invention.

The combustor 24 may be any type of combustor known in the art, and the present invention is not limited to any particular combustor design unless specifically recited in the claims. For example, the combustor 24 may be a can type or a can-annular type of combustor. FIG. 2 provides a perspective side view of a portion of an exemplary can type combustor 100 as may be incorporated in the gas turbine 10 shown in FIG. 1, according to one or more embodiments of the present invention.

In an exemplary embodiment, as shown in FIG. 2, the combustor 100 includes a plurality of bundled tube fuel nozzles 102 herein referred to as fuel nozzles 102 annularly arranged around a common axial centerline 104. In particular embodiments, the fuel nozzles 102 may be annularly arranged around a center fuel nozzle 106 which is substantially coaxially aligned with centerline 104. Each fuel nozzle 102 includes a fuel plenum 108, a retention plate 110 connected to the fuel plenum 108 and a plurality of premix tubes 112 which extend substantially axially through the fuel plenum 108 and the retention plate 110 with respect to centerline 104.

Figure 3:
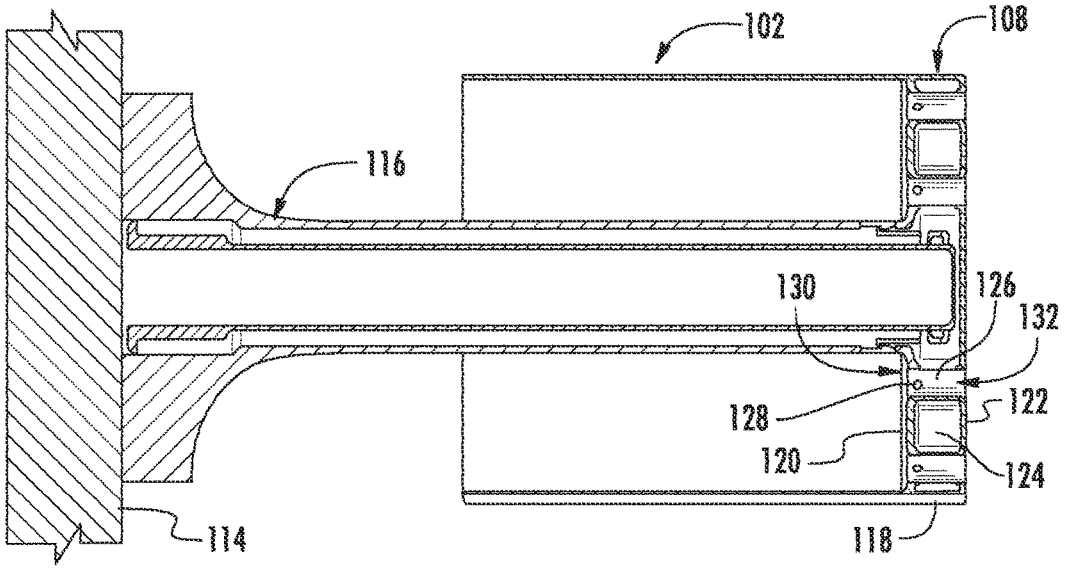
FIG. 3 is a cross sectional side view of a portion of an exemplary bundled tube fuel nozzle as may incorporate various embodiments of the present invention.

FIG. 3 is a cross sectional side view of a portion of the exemplary fuel nozzle 102 as shown in FIG. 2 with the retention plate 110 and the premix tubes 112 removed for clarity, according to at least one embodiment of the present invention. In particular embodiments, as shown in FIGS. 2 and 3, each fuel nozzle 102 is connected to an end cover 114 of the combustor 100 via a corresponding conduit or tube 116. The conduit 116 extends axially downstream from the end cover 114 and provides for fluid communication between the end cover 114 and/or a fuel supply (not shown) and a corresponding fuel plenum 108. In addition, the conduits 116 may provide structural support for the generally cantilevered fuel nozzles 102.

As shown in FIG. 3, the fuel plenum 108 generally comprises a fuel plenum body 118 having a forward or upstream side 120 axially spaced from an aft or downstream side 122. A fuel plenum or volume 124 is defined between the forward and aft sides 120, 122. At least one premix passage 126 extends through and is in fluid communication with the fuel plenum 124 via one or more fuel ports 128. The premix passage 126 includes an inlet 130 which is defined along the forward side 120 and an outlet 132 which is defined along the aft side 122. In particular embodiments, the fuel plenum 108 includes a plurality of the premix passages 126. The fuel plenum body 118 may be cast as a single component or may be assembled from one or more plates, tubes and or shrouds.

Figure 4:
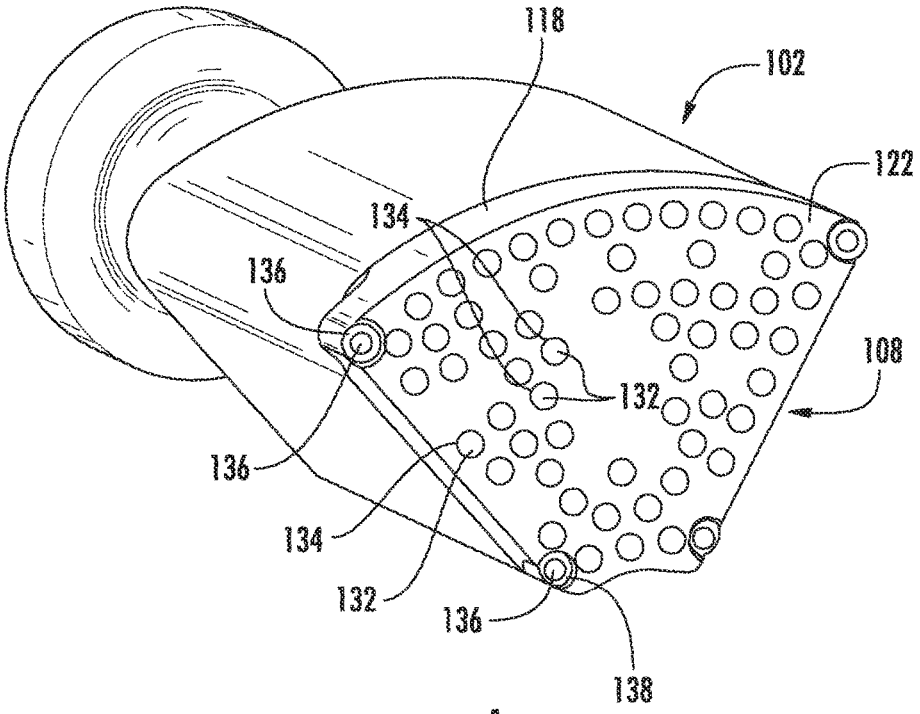
FIG. 4 is a perspective view of the bundled tube fuel nozzle as shown in FIG. 3, according to at least one embodiment of the present invention.

FIG. 4 provides a perspective view of the fuel plenum 108 as shown in FIG. 3, according to at least one embodiment of the present invention. In one embodiment, as shown in FIG. 4, at least one outlet 132 includes a counterbore or groove 134 which circumferentially surrounds the outlet 128. The counterbore 134 is defined along the aft side 122 of the fuel plenum body 118. In particular embodiments, multiple counterbores 134 are formed along the aft side 122 where each is defined around a corresponding outlet 132. In one embodiment, the aft side 122 defines one or more fastener holes or passages 136. The fastener hole 136 may be positioned at various locations such as along an outer perimeter of the aft side 122 of the fuel plenum body 118. Each or at least some of the fastener holes 136 may be at least partially surrounded by a counterbore 138.

Figure 5:
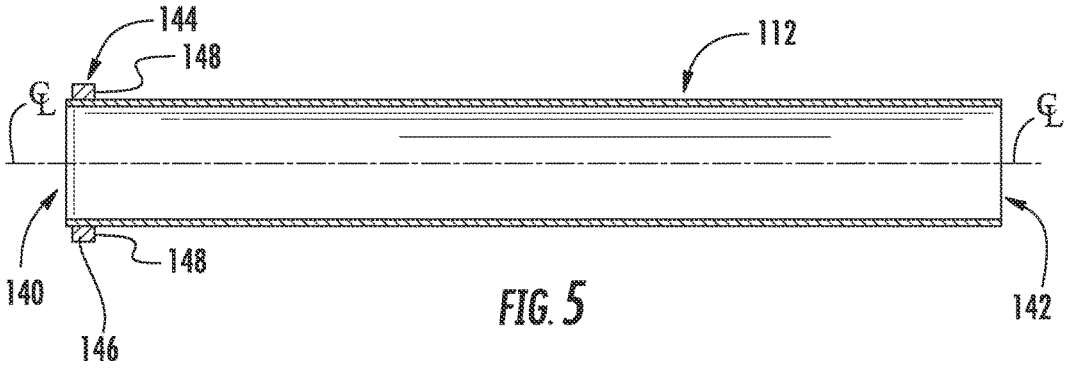
FIG. 5 is a cross sectional side view of an exemplary premix tube according to one embodiment of the present invention.

FIG. 5 is a cross sectional side view of an exemplary premix tube 112 according to at least one embodiment of the present invention. As shown in FIG. 5, the premix tube 112 generally includes an inlet end 140, an outlet end 142 and a spring support or retention feature 144 disposed proximate to the inlet end 140. In one embodiment, the spring support feature 144 comprises a collar or flange 146 which extends radially outwardly from the premix tube 112 with respect to an axial centerline of the premix tube 112. The collar 146 at least partially defines a contact surface 148. In particular embodiments, the spring support feature 144 extends at least partially circumferentially around the premix tube 112.

Figure 6:
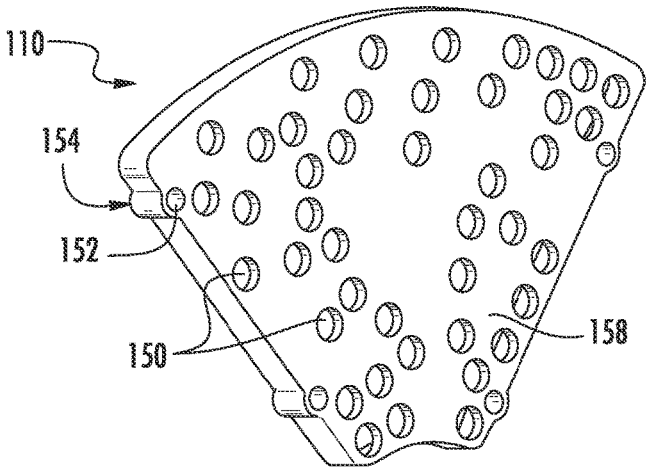
FIG. 6 is an upstream perspective view of an exemplary retention plate according to at least one embodiment of the present invention.
Figure 7:
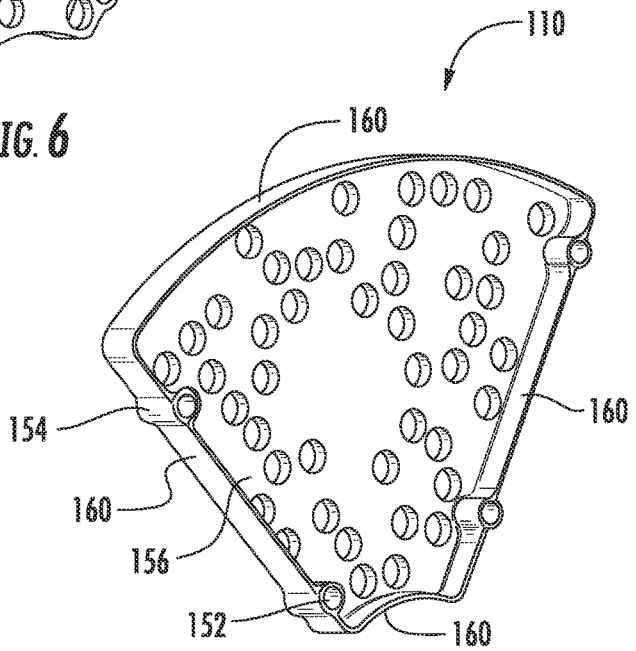
FIG. 7 is a downstream perspective view of an exemplary retention plate according to at least one embodiment of the present invention.

FIG. 6 provides a front perspective view of an exemplary retention plate 110 according to at least one embodiment of the present invention. FIG. 7 provides an aft perspective view of the exemplary retention plate 110 as shown in FIG. 6, according to one embodiment of the present invention. The retention plate 110 is generally shaped or formed to extend radially and circumferentially across the aft side 122 of the fuel plenum body 116. As shown in FIGS. 6 and 7, the retention plate 110 includes one or more premix tube holes 150. As shown in FIG. 2, the premix tube holes 150 are generally sized and shaped to receive a corresponding premix tube 112 therethrough.

The premix tube holes 150 are generally arranged across the retention plate 110 so as to align with the premix fuel passages 126 (FIG. 3). In one embodiment, as shown in FIGS. 6 and 7, the retention plate 110 includes one or more fastener holes 152. The fastener holes 152 may extend substantially axially through the retention plate 110 and/or through corresponding bosses 154 of the retention plate 110. The fastener holes 152 and/or bosses 154 generally align with the fastener holes 136 of the fuel plenum body 118. The bosses 154 may provide axial separation between the fuel plenum body 118 and the retention plate 110. In other embodiments, a busing or spacer may be disposed between the retention plate 110 and the fuel plenum body 118, thus providing axial separation therebetween. For example, the bushing/spacer may be coaxially aligned with the bosses 154 and/or fastener holes 152.

As shown in FIG. 7, the retention plate 110 includes an upstream side 156 which faces the aft side 122 of the fuel plenum body 118 when mounted thereto. As shown in FIG. 6, the retention plate 110 further includes an axially opposing downstream side 158. In one embodiment, as shown in FIG. 7, the retention plate 110 further includes a wall portion 160 which extends along an outer perimeter of the retention plate 110 substantially perpendicular to the upstream side 156 and extends axially towards the towards the aft side 122 of the fuel plenum body 118 when mounted thereto. In particular embodiments, the retention plate 110 may be substantially flat, for example, without the wall portion 160.

Figure 8:
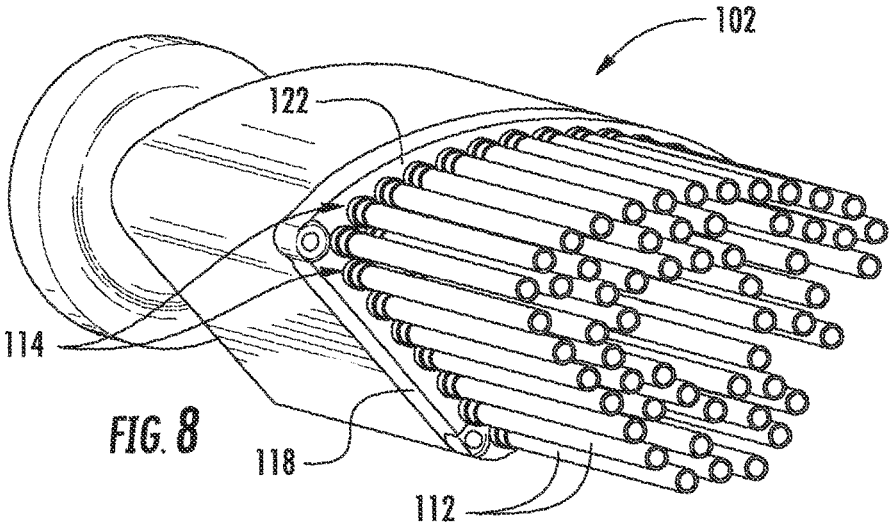
FIG. 8 is a perspective view of a portion of a bundled tube fuel nozzle as shown in FIG. 2, according to at least one embodiment of the present invention.

FIG. 8 provides a perspective of the fuel nozzle 102 with the retention plate 144 removed for clarity. As shown in FIG. 8, each premix tube 112 is aligned with a corresponding premix passage 126 (FIG. 3). As shown in FIG. 8, each premix tube 112 extends downstream from its corresponding premix passage 126, thus defining a premix flow path between the fuel plenum 124 (FIG. 3) and the combustion zone (not shown). As shown in FIG. 8, the spring support feature 144 of each premix tube 112 is disposed proximate to the aft side 122 of the fuel plenum body 118.

Figure 9:
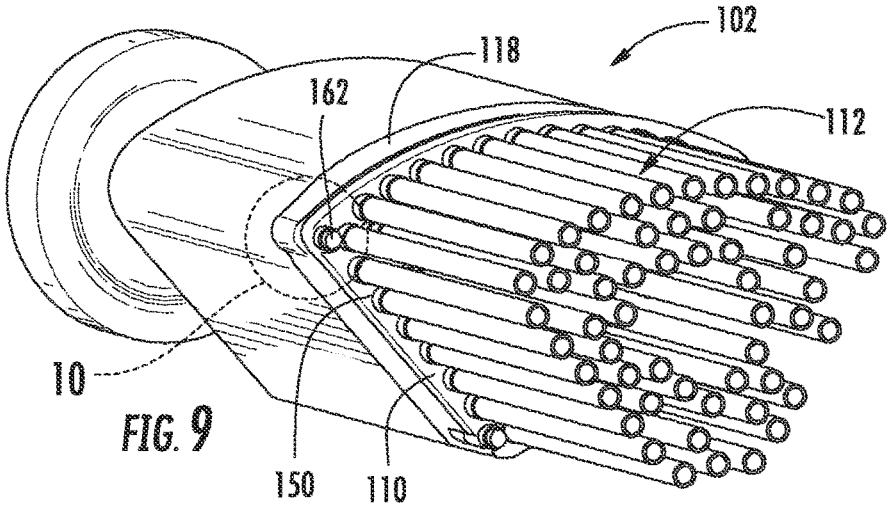
FIG. 9 is a perspective view of a bundled tube fuel nozzle as shown in FIG. 2, according to at least one embodiment of the present invention.

FIG. 9 provides a perspective view of an assemble fuel nozzle 102 including the fuel plenum body 118, the retention plate 110 and a plurality of premix tubes 112 according to one embodiment of the present invention. As shown in FIG. 9, each premix tube 112 extends through a corresponding premix tube hole 150 of the retention plate 110. As shown, the retention plate 110 may be connected or fastened to the fuel plenum body 118 via one or more fasteners 162 such as bolts or other suitable mechanical fasteners.

Figure 10:
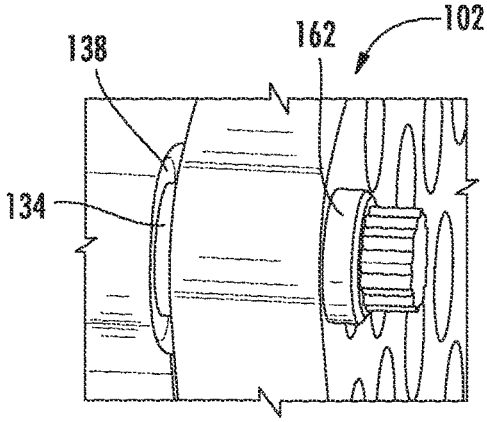
FIG. 10 is an enlarged view of a portion of the bundled tube fuel nozzle as shown in FIG. 9, according to one embodiment of the present invention.

FIG. 10 is an enlarged view of a portion of the fuel nozzle 102 including an exemplary fastener 162. In one embodiment, as shown in FIG. 10, the boss 154 of the retention plate 110 extends into the counterbore 138 of the fuel plenum body 118, thereby reducing contact area between the retention plate 110 and the fuel plenum body 118 and eliminating contact between the collar flange 146 and the fuel plenum 118. As a result, heat transfer between the two components is reduced.

Figure 11:
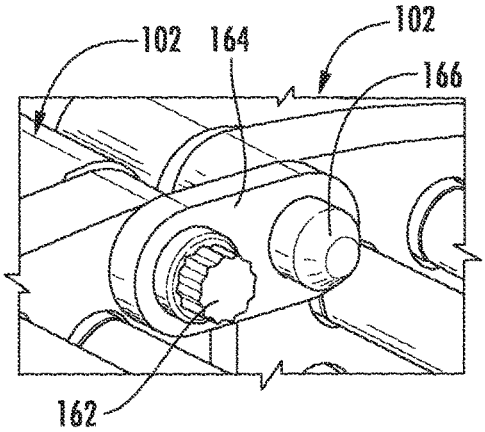
FIG. 11 is an enlarged partial view of two adjacent bundled fuel nozzles according to one embodiment of the present invention.

FIG. 11 provides an enlarged view of portions of two adjacent fuel nozzles 102. As shown in FIG. 11, adjacent fuel nozzles 102 may be coupled together by a mechanical linkage 164. For example, a fastener 162 and a pin 166 may be used to link the adjacent fuels nozzles 102, thus providing support and/or dampening to the otherwise cantilevered fuel nozzles 102.

Figure 12:
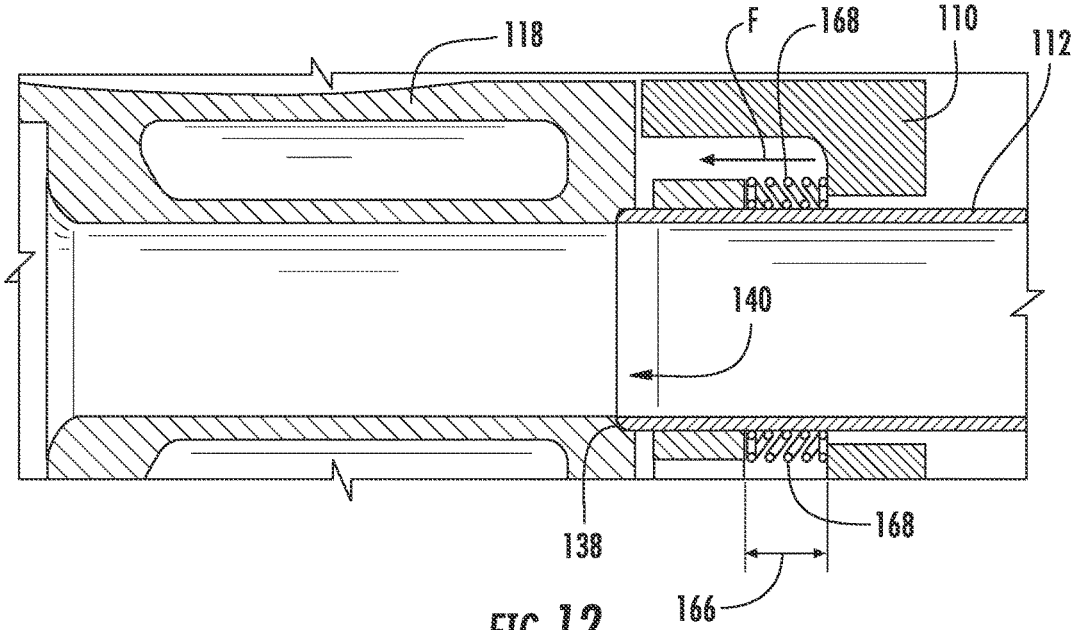
FIG. 12 is a cross sectional side view of a portion of the bundled fuel nozzle as shown in FIG. 9, according to various embodiments of the present invention.

FIG. 12 provides a cross sectional side view of a portion of the assembled fuel nozzle 102 as shown in FIG. 8 including a portion of the fuel plenum body 118, a portion of an exemplary premix tube 112 and a portion of the retention plate 110. In various embodiments, an axial or spring gap 166 is defined between the spring support feature 144 and the retention plate 110. When the retention plate 110 is installed or connected to the fuel plenum body 118, a spring 168 extends within the spring gap 166 between the retention plate 110 and the spring support feature 144. The spring may extend between the spring contact surface 148 and the upstream side 156 of the retention plate 110. The spring 168 provides an axial force F to the spring support feature 144 and/or the premix tube 112, thus seating the premix tube 112 against the fuel plenum body 118.

Figure 13:
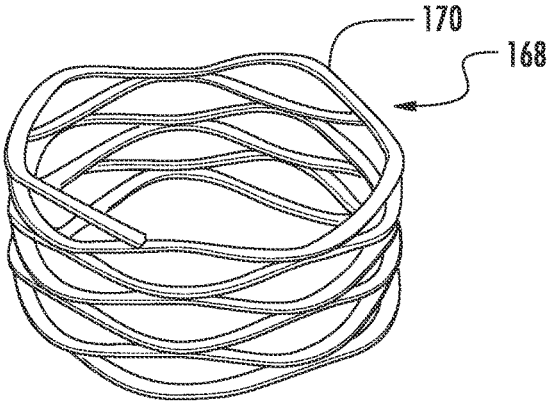
FIG. 13 is a perspective view of an exemplary spring as may be incorporated into the bundled tube fuel nozzle as show in FIG. 12, according to one embodiment of the present invention.

In one embodiment, as shown in FIG. 11, the inlet end portion 140 of the premix tube 112 may be seated within a corresponding counterbore 138 of the fuel plenum body 118. In particular embodiments, the spring 168 extends at least partially circumferentially around the premix tube 112. The spring 168 may be any spring which is suitable for applying axial force F to the spring support feature 144 and/or the premix tube 112. For example, in one embodiment, as shown in FIG. 13, the spring 168 may be a compression wave spring 170. In other embodiments the spring 168 may be a helical spring or other spring member which extends within the spring gap 166 between the retention plate and the spring support feature 144.

During assembly of fuel nozzle 102, each premix tube 112 may be aligned with a corresponding premix passage 126 outlet 132. A spring 168 may be placed or installed around each premix tube 112 before or after aligning the premix tubes 112 with the corresponding premix passage 126 outlets 132. The retention plate 110 is then guided over the premix tubes 112 and each premix tube 112 is received in a corresponding premix tube hole 150. The retention plate 110 may then be guided towards the fuel plenum body 118. One or more fasteners 162 may then be inserted into the fastener holes 152, 136 and tightened so as to connect the retention plate 110 to the fuel plenum body 118.

The springs 168 are compressed as the fasteners 162 are tightened, thus providing the axial or retention force F required to seat the inlet ends 140 of each premix tube 112 against the aft side 122 of the fuel plenum body 118. As a result, a permanent connection such as a braze joint or weld joint is avoided, thus significantly reducing assembly time. In addition or in the alternative, the spring retention of the premix tubes 112 allows for disassembly of the premix tube 112 from the fuel plenum 108 for repair and/or replacement of a damaged premix tube 112. In addition, by each fuel nozzle 102 having its own retention plate 110, each individual fuel nozzle 102 may have free thermal growth during startup/shutdown transients and fuel staging. In addition or in the alternative, the pins 164 may be used to tie adjacent fuel nozzles 102 together while maintaining the thermal compliance, thus reducing overall thermal and/or mechanical stresses on the fuel plenum body 118, particularly at the aft side 122.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A system for retaining a fuel nozzle premix tube, comprising:

a retention plate;

a premix tube which extends downstream from an outlet of a premix passage defined along an aft side of a fuel plenum body, the premix tube having an inlet end and a spring support feature disposed proximate to the inlet end, wherein the premix tube extends through the retention plate and the spring support feature is disposed between the aft side of the fuel plenum body and the retention plate, wherein the aft side of the fuel plenum body includes a counterbore around the outlet of the premix passage, wherein the counterbore is sized to receive the inlet end of the premix tube; and a spring extending between the spring support feature and the retention plate.

2. The system as in claim 1, wherein the spring applies an axial force to the premix tube to seat the inlet end of the premix tube against the aft side of the fuel plenum body.

3. The system as in claim 1, wherein the spring support feature comprises a flange which extends circumferentially around the premix tube and which defines a contact surface, the spring extending axially between the contact surface and the retention plate.

4. The system as in claim 1, wherein the spring comprises a wave compression spring.

5. The system as in claim 1, wherein the retention plate is fastened to the fuel plenum body via one or more mechanical fasteners.

6. The system as in claim 1, wherein the retention plate includes an upstream side which faces the aft side of the fuel plenum body, an axially opposing downstream side and a wall which extends along an outer perimeter of the retention plate substantially perpendicular to the upstream side towards the aft side of the fuel plenum body.

7. A fuel nozzle, comprising:

a fuel plenum body having a forward side axially spaced from an aft side, a fuel plenum defined between the forward and aft sides and a premix passage which extends through the fuel plenum and is in fluid communication with the fuel plenum, the premix passage having an inlet at the forward side and an outlet at the aft side;

a premix tube which extends downstream from the outlet of the premix passage, the premix tube having an inlet end and a spring support feature disposed proximate to the inlet end, wherein the aft side of the fuel plenum body includes a counterbore around the outlet of the premix passage, wherein the counterbore is sized to receive the inlet end of the premix tube;

a retention plate defining a premix tube hole, the premix tube extending through the premix tube hole, wherein the spring support feature is disposed between the aft side and the retention plate; and a spring extending between the spring support feature and the retention plate.

8. The fuel nozzle as in claim 7, wherein the spring applies an axial force to the premix tube to seat the inlet end of the premix tube against the aft side of the fuel plenum body.

9. The fuel nozzle as in claim 7, wherein the spring support feature comprises a flange which extends circumferentially around the premix tube and which defines a contact surface, the spring extending axially between the contact surface and the retention plate.

10. The fuel nozzle as in claim 7, wherein the spring comprises a wave compression spring.

11. The fuel nozzle as in claim 7, wherein the retention plate is fastened to the fuel plenum body via one or more mechanical fasteners.

12. The fuel nozzle as in claim 7, wherein the retention plate includes an upstream side which faces the aft side of the fuel plenum body, an axially opposing downstream side and a wall which extends along an outer perimeter of the retention plate substantially perpendicular to the upstream side towards the aft side of the fuel plenum body.

13. A gas turbine, comprising:

a compressor section, a combustion section downstream from the compressor section and a turbine section downstream from the combustion section, the combustion section having a combustor, the combustor comprising a plurality of fuel nozzles annularly arranged around a common axial centerline, wherein each fuel nozzle comprises:

a fuel plenum body including a forward side axially spaced from an aft side, a fuel plenum defined between the forward and aft sides and a plurality of premix passages in fluid communication with the corresponding fuel plenum, each premix passage having an inlet defined along the forward side and an outlet defined along the aft side of the fuel plenum body;

a plurality of premix tubes, each premix tube extending downstream from a corresponding premix passage outlet, each premix tube having an inlet end and a spring support feature disposed proximate to the inlet end, wherein the aft side of the fuel plenum body includes counterbore around the outlet of the premix passage, wherein the counterbore is sized to receive the inlet end of the premix tube;

a retention plate defining a plurality of premix tube holes, each premix tube extending through a corresponding premix tube hole, wherein the spring support features are disposed between the aft side and the retention plate; and a plurality of springs, each spring at least partially surrounding a corresponding premix tube, wherein each spring extends between the spring support feature of the corresponding premix tube and the retention plate.

14. The gas turbine as in claim 13, wherein each spring applies an axial force to the corresponding premix tube to seat the inlet end of corresponding premix tube against the aft side of the fuel plenum body.

15. The gas turbine as in claim 13, wherein the spring support feature of at least one premix tube comprises a flange which extends circumferentially around the premix tube.

16. The gas turbine as in claim 13, wherein at least one of the plurality of springs is a wave compression spring.

17. The gas turbine as in claim 13, wherein a first retention plate of a first fuel nozzle of the plurality of fuel nozzles is coupled to a second retention plate of a second fuel nozzle of the plurality of fuel nozzles.

* * * * *